US010559926B2

(12) United States Patent
Chen et al.

(10) Patent No.: US 10,559,926 B2
(45) Date of Patent: Feb. 11, 2020

(54) HIGH FREQUENCY ELECTRICAL CONNECTOR

(71) Applicant: FOXCONN INTERCONNECT TECHNOLOGY LIMITED, Grand Cayman (KY)

(72) Inventors: De-Jin Chen, ShenZhen (CN); Xing-Liang Liu, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/100,190

(22) Filed: Aug. 9, 2018

(65) Prior Publication Data

US 2019/0052020 A1 Feb. 14, 2019

(30) Foreign Application Priority Data

Aug. 10, 2017 (CN) ..... 2017 1 0680718

(51) Int. Cl.

| | |
|---|---|
| ***H01R 13/6471*** | (2011.01) |
| ***H01R 13/514*** | (2006.01) |
| ***H01R 13/504*** | (2006.01) |
| ***H01R 13/6599*** | (2011.01) |
| ***H01R 24/64*** | (2011.01) |
| ***H01R 24/62*** | (2011.01) |
| ***H01R 12/73*** | (2011.01) |

(Continued)

(52) U.S. Cl.

CPC ..... *H01R 13/6471* (2013.01); *H01R 12/735* (2013.01); *H01R 13/504* (2013.01); *H01R 13/514* (2013.01); *H01R 13/6599* (2013.01); *H01R 24/64* (2013.01); *H01R 12/722* (2013.01); *H01R 13/6587* (2013.01); *H01R 24/62* (2013.01)

(58) Field of Classification Search

CPC ..... H01R 13/504; H01R 13/514; H01R 13/6461; H01R 13/6471; H01R 13/6587; H01R 12/722; H01R 12/735; H01R 24/62; H01R 24/64; H01R 13/6599

See application file for complete search history.

(56) References Cited

U.S. PATENT DOCUMENTS

| | | | | |
|---|---|---|---|---|
| 7,914,302 | B1 * | 3/2011 | Zhu | H01R 13/41 439/79 |
| 9,583,882 | B1 * | 2/2017 | Hsueh | H01R 13/6471 |
| 10,283,910 | B1 * | 5/2019 | Chen | H01R 4/04 |

(Continued)

FOREIGN PATENT DOCUMENTS

| | | |
|---|---|---|
| TW | M419266 | 12/2011 |

*Primary Examiner* — Oscar C Jimenez

(74) *Attorney, Agent, or Firm* — Wei Te Chung; Ming Chieh Chang

(57) ABSTRACT

A high frequency electrical connector including a plastic housing and a plurality of contacts retained by the plastic housing. The contacts include a plurality of differential pair signal contacts and a plurality of grounding contacts beside the signal contacts, respectively. The plastic housing includes the insulative plastic portion and the conductive plastic portion to which the insulative plastic portion is assembled. The signal contacts are retained in the insulative plastic portion while the grounding contacts are retained in the conductive plastic portion wherein the signal contacts are isolated from the conductive plastic portion via the insulative plastic portion.

20 Claims, 7 Drawing Sheets

(51) Int. Cl.
*H01R 12/72* (2011.01)
*H01R 13/6587* (2011.01)

(56) References Cited

U.S. PATENT DOCUMENTS

2012/0238145 A1* 9/2012 Zhang ..... H01R 12/7005
439/660
2012/0282808 A1* 11/2012 Luo ..... H01R 12/725
439/607.28
2013/0034998 A1* 2/2013 Cina ..... H01R 12/721
439/629
2013/0149882 A1* 6/2013 Luo ..... H01R 13/652
439/108
2013/0273778 A1* 10/2013 Jiang ..... H01R 13/6477
439/626
2013/0288513 A1* 10/2013 Masubuchi ..... H01R 12/775
439/386
2015/0200503 A1* 7/2015 Hsiao ..... H01R 4/04
439/676
2016/0190746 A1* 6/2016 Goh ..... H01R 13/6471
439/626

* cited by examiner

HIGH FREQUENCY ELECTRICAL CONNECTOR

BACKGROUND OF THE INVENTION

1. Field of the Invention

The present invention relates to a high frequency electrical connector, and particularly to the electrical connector with the signal contacts enclosed in the insulator and further assembled into the corresponding cavity of the conductive plastic housing in which the related grounding contacts are already retained so both the signal contacts and the grounding contacts are commonly arranged in a same mating port for mating with a complementary connector.

2. Description of Related Art

Taiwan Utility Patent No. M419266 discloses a high frequency electrical connector including an insulative housing and a plurality of contacts. The housing includes a forwardly extending mating tongue with two opposite first and second surfaces thereon. The contacts includes at least two grounding contacts and one differential pair signal contacts therebetween. A grounding bar is assembled to the housing, having corresponding tangs respectively contacting the corresponding grounding contacts. Anyhow, because the grounding bar is discrete from but assembled to the housing, thus tending to have inferior securing therebetween and the corresponding inferior electrical and mechanical connection with the corresponding grounding contacts disadvantageously, if the manufacturing tolerance is out of range.

It is desired to have an electrical connector with the corresponding grounding piece securely and reliably associated with the housing to have superior electrical and mechanical connection between the grounding piece and the corresponding grounding contacts advantageously.

SUMMARY OF THE INVENTION

An object of the invention is to provide a high frequency electrical connector including a plastic housing and a plurality of contacts retained by the plastic housing. The contacts include a plurality of differential pair signal contacts and a plurality of grounding contacts beside the signal contacts, respectively. The plastic housing includes the insulative plastic portion and the conductive plastic portion to which the insulative plastic portion is assembled. The signal contacts are retained in the insulative plastic portion while the grounding contacts are retained in the conductive plastic portion wherein the signal contacts are isolated from the conductive plastic portion via the insulative plastic portion.

A method of making the aforementioned electrical connector comprises the following steps: (1) insert-molding a plurality of grounding contact within a conductive plastic portion to commonly form a primary sub-assembly; (2) insert-molding a plurality of differential pair signal contacts within an insulative plastic portion to form a secondary sub-assembly; and (3) assembling the secondary sub-assembly to the primary sub-assembly to commonly form a mating port.

Other objects, advantages and novel features of the invention will become more apparent from the following detailed description when taken in conjunction with the accompanying drawings.

DETAILED DESCRIPTION OF THE PREFERRED EMBODIMENT

Figure 1:
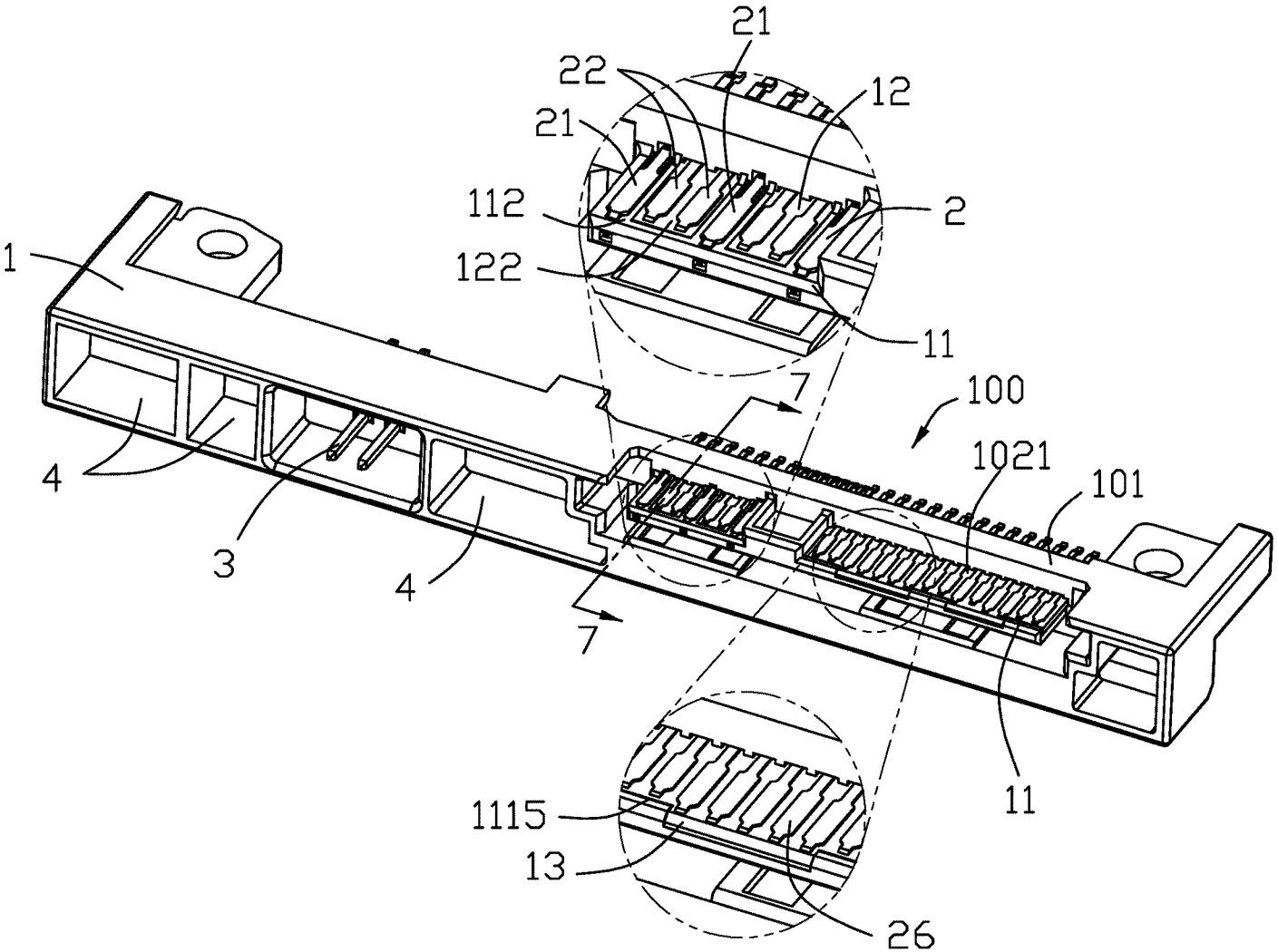
FIG. 1 is a front downward perspective view of an electrical connector according to the invention.
Figure 2:
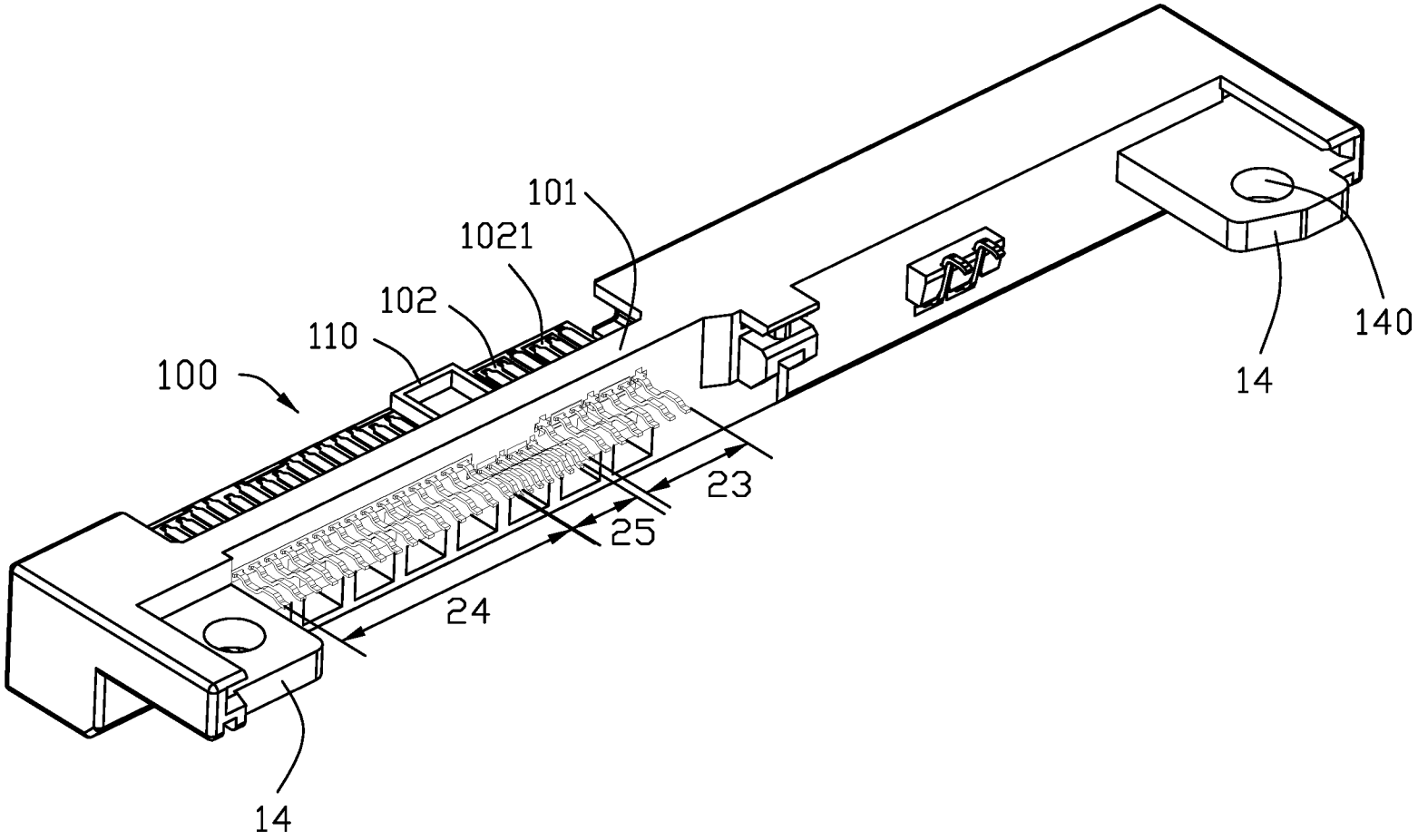
FIG. 2 is a rear downward perspective view of the electrical connector of FIG. 1.
Figure 3:
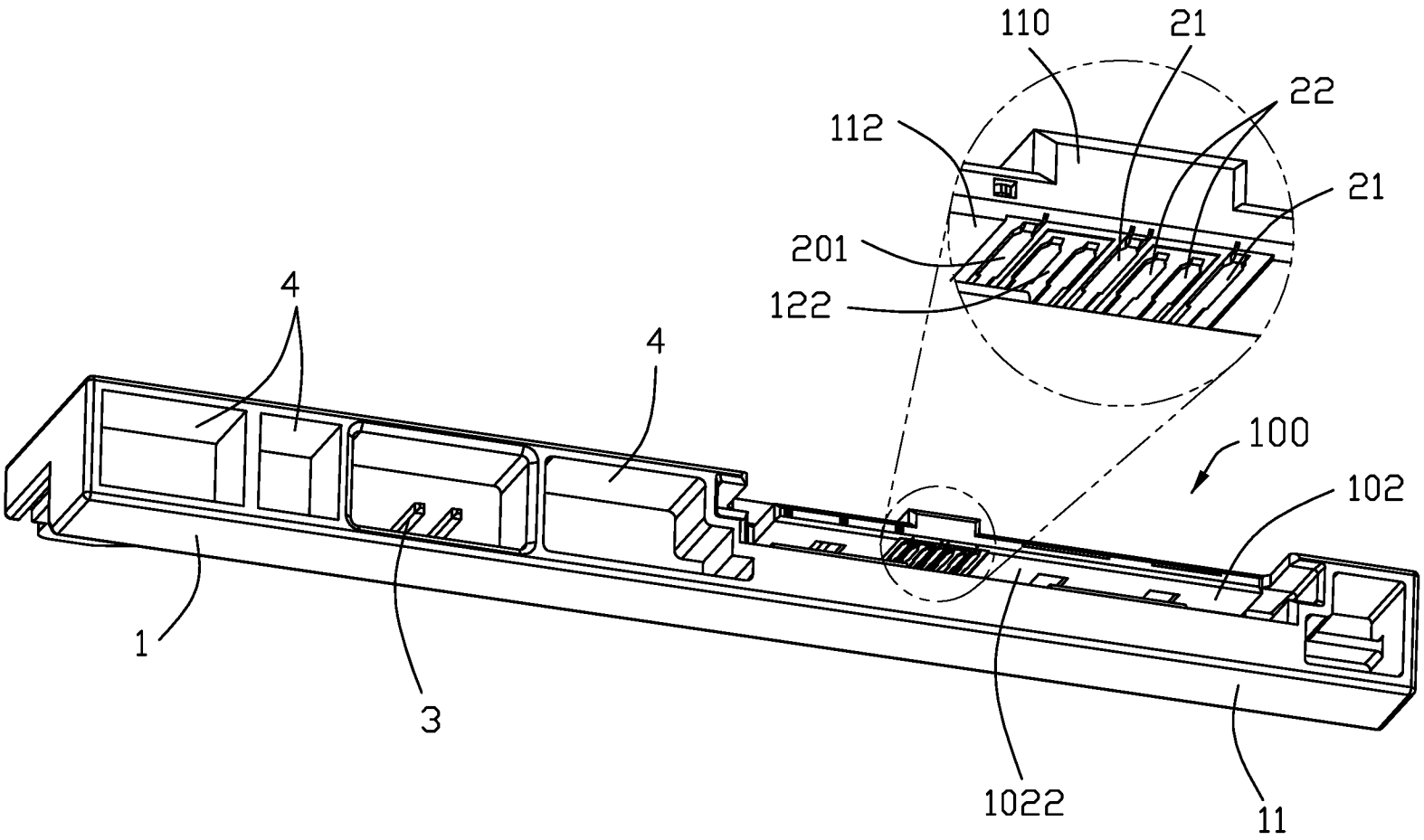
FIG. 3 is a front downward perspective view of the electrical connector of FIG. 1.
Figure 4:
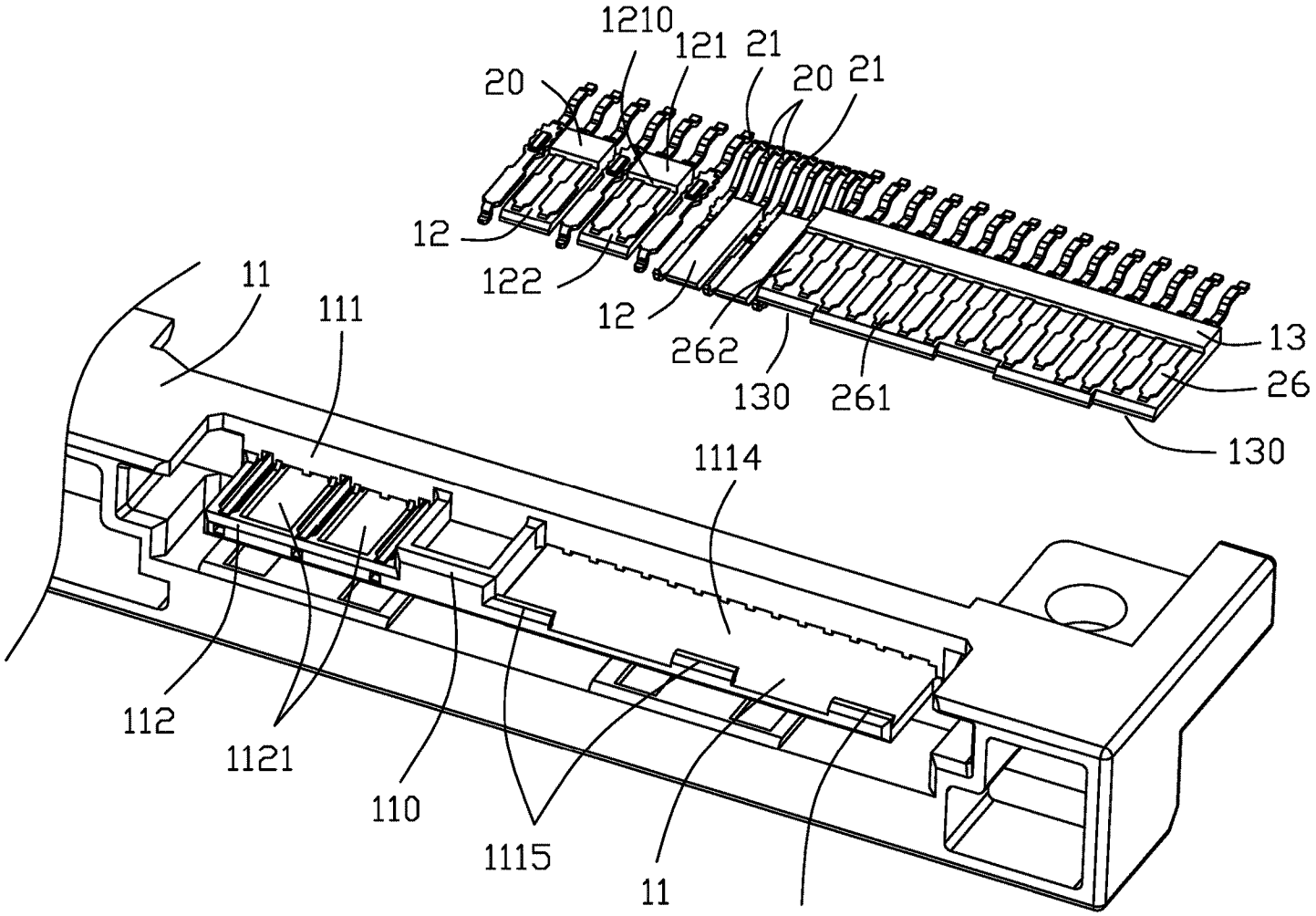
FIG. 4 is a front downward exploded perspective view of the electrical connector of FIG. 1.
Figure 5:
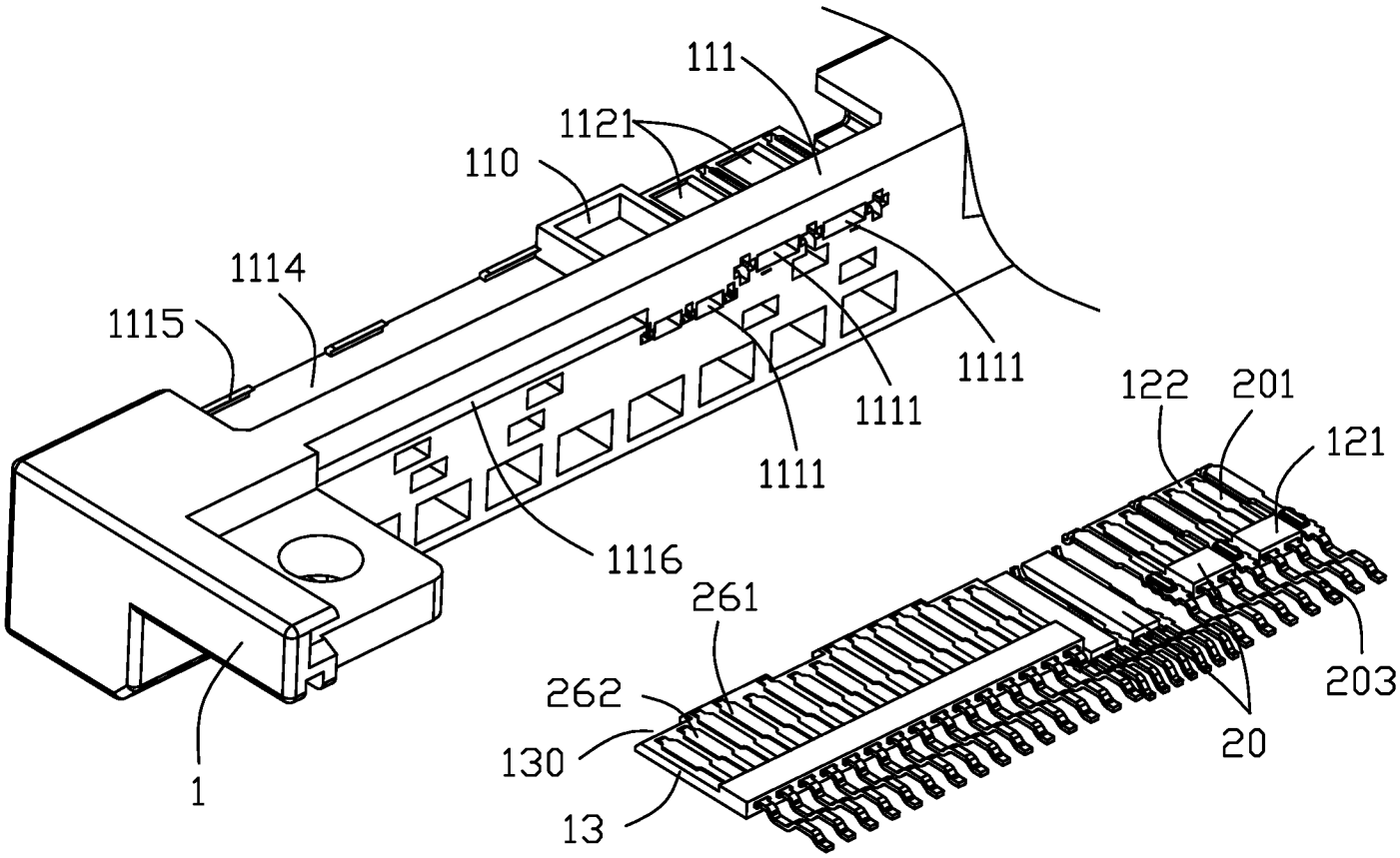
FIG. 5 is a rear downward exploded perspective view of the electrical connector of FIG. 2.
Figure 6:
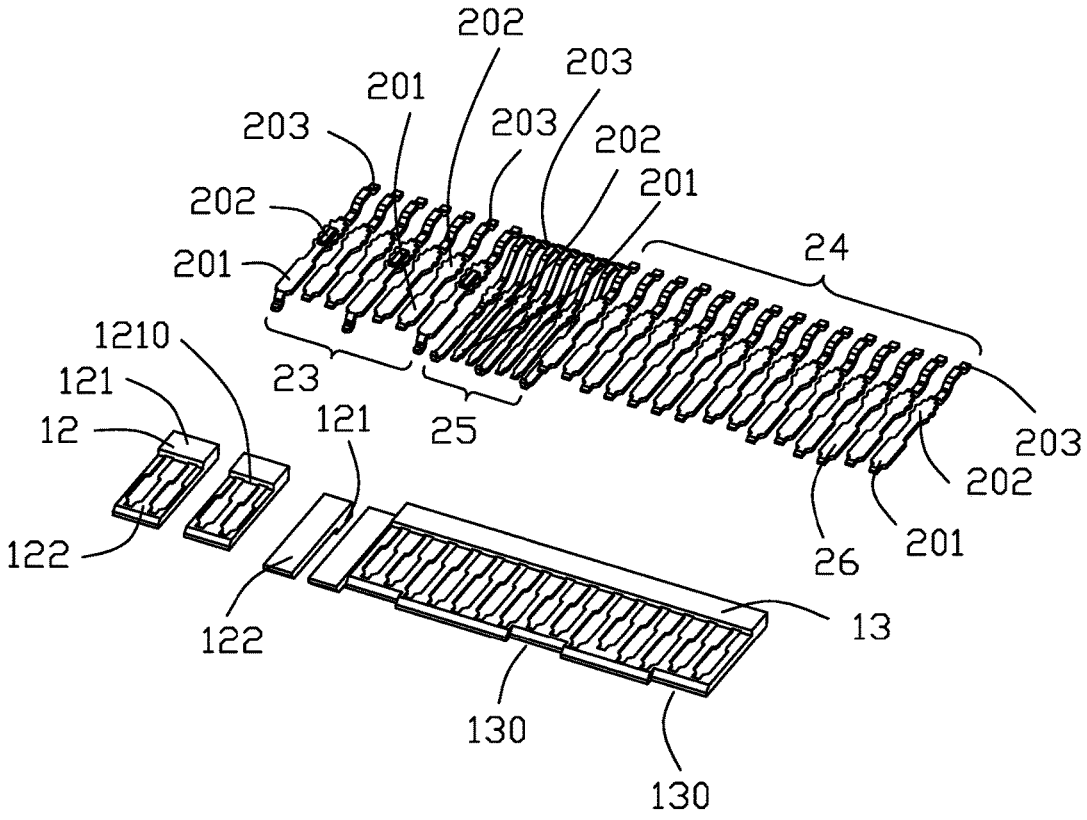
FIG. 6 is a front downward perspective view of the second sub-assembly of the electrical connector of FIG. 4.
Figure 7:
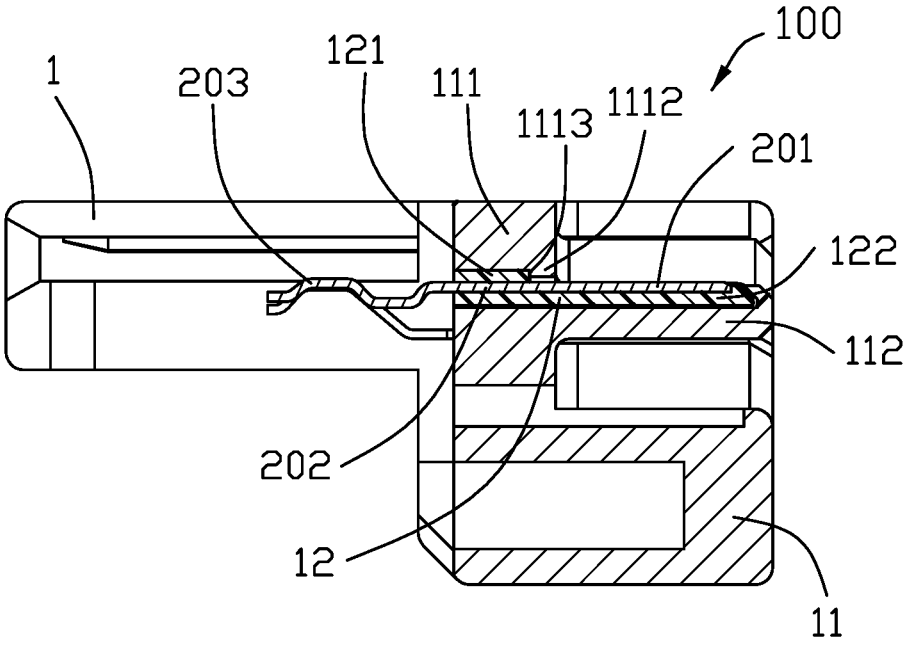
FIG. 7 is a side view of the electrical connector of FIG. 1.

Referring to FIGS. 1-7, the electrical connector 100 includes a plastic housing 1 and a plurality of conductive contacts 2 disposed in the housing 1. The contacts 2 include a plurality of differential pair signal contacts 22 and a plurality of grounding contacts 21 by two sides of the corresponding differentia pair signal contacts 22, respectively. The plastic housing 1 include a conductive plastic portion 11 and the insulative plastic portion 12. The grounding contacts 21 are retained in the conductive plastic portion 11 either via an insert-molding process or a mechanical assembling process, to achieve the mechanical and electrical connection therebetween and commonly form a primary sub-assembly (not labeled). The differential pair signal contacts 22 are optionally insert-molded within the insulative plastic portion 12 to commonly form a secondary sub-assembly or a so-called contact module 20. The contact module 20 is assembled unto the conductive plastic portion 11 of the primary sub-assembly wherein the differential pair signal contacts 22 are isolated from the conductive plastic portion 11 via the insulative plastic portion 11.

The conductive plastic portion 11 includes a conductive base 111 and a conductive mating tongue 112 extending forwardly therefrom. The insulative plastic portion 12 includes an insulative base 121 and an insulative mating tongue 122 extending forwardly therefrom. Each of the differential pair signal contacts 22 includes a contacting section 201, the tail section 203 and an intermediate section 202 therebetween. The contacting section 201 is primarily embedded within the mating tongue 122 except a mating region exposed upon the mating surface of the insulative mating tongue 122. The tail section 203 is exposed outside of the insulative base 121. The insulative mating tongue 122 is essentially assembled to the conductive mating tongue 112 to commonly form a complete mating tongue 102. The insulative base 121 is retained in the conductive base 111.

The conductive base 111 forms a plurality of receiving holes 1111 to receive the corresponding insulative base 121 therein. The conductive mating tongue 112 forms a plurality of mounting recesses 1121 in communication with the corresponding receiving holes 1111 along the front-to-back direction so as to allow the corresponding insulative mating tongues 122 to be inserted into the corresponding mounting recesses 1121 via the corresponding receiving holes 1111, respectively. The mounting recess 1121 is recessed from a mating surface of the mating tongue 102 while terminated before reach the opposite surface in the vertical direction. After assembled, the surface of the insulative mating tongue 122 is coplanar with that of the conductive mating tongue 112. Corresponding to the receiving hole 1111, the conductive base 111 form the stopping block 1112 with the stopping surface 1113 thereon. The front end 1210 of the insulative base 121 abuts forwardly against the stopping surface 1113. The receiving hole 1111 is dimensioned to be snugly compliant with the dimension of the insulative base 121 so as to have the corresponding contact module 20 reliably retained in the conductive plastic portion 11.

The plastic housing 1 includes a base 101 and the mating tongue 102 extending forwardly from the base 101 wherein the base 101 includes the aforementioned conductive base 111 and the insulative base 121, the mating tongue 102 forms opposite first surface 1021 and the second surface 1022. The contact 2 has the contacting section 201 exposed upon the mating surface of the mating tongue 102, the intermediate section 202 retained in the base 101, and the tail section 203 extending outside of the base 101. The first surface 1021 forms a plurality of ribs 110 to separate the first surface 1021 into two parts. The contacts 2 are arranged in a first group 23, the second group 24 and the third group 25. The contacts in the first group 23 are located by one side of the rib 110 on the first surface 1021, while those in the second group 24 are located by the other side thereof, and those in the third group 25 are located on the second surface 1022 corresponding to the rib 100.

In the first group 21, the second group 23 and the third group 25, a plurality of differential pair signal contacts 22 and a plurality of grounding contact 21 by two sides of the differential pair signal contacts 22. The differential pair signal contacts 22 are embedded within the corresponding insulative plastic portion 12 to commonly form the contact module 20.

In the second group 24, the contacts 2 include the power contacts 26, and the plastic housing 1 further includes the insulative block 13 enclosing the power contacts 26 and isolating the power contacts 26 from the conductive plastic portion 11, thus assuring the relatively large power may be transferred by the power contacts 26. The conductive base 111 forms a receiving portion 1116 so as to allow the insulative block 13 to be forwardly assembled to the conductive plastic portion 11 via the receiving portion 1116. The power contacts 26 include a plurality of longer first power contacts 261 and a plurality of shorter second power contacts 262. The insulative block 13 forms notches 130 corresponding to the shorter second power contacts 262. The conductive plastic portion 11 forms a mounting cavity 1114 to receive the insulative block 13, and a stopping block 1115 in front of the mounting cavity 1114. The stopping block 1115 is received within the corresponding notch 130.

The connector 100 further includes testing contacts 3, and the hollows 4 for molding fluidity consideration. The plastic housing 1 further includes a mounting section 14 extending from two opposite ends of the conductive base 111 with mounting holes 140 for mounting to the electrical connector 100 to a printed circuit board (not shown).

In brief, the grounding contacts 21 are integrally formed within the conductive plastic portion 11, and the signal contacts 22 are integrally formed within the insulative plastic portion 12 to commonly form the contact module 20 and successively assembled into the conductive plastic portion 11 wherein the signal contacts 22 are isolated from the conductive plastic portion 11 via the insulative plastic portion 12 while the signal contacts 22 and the grounding contacts 21 are arranged in the same mating port and optimally in the same row in an intimate manner. In addition, the mating tongue 102 is essentially compose of the conductive mating tongue 112 with the insulative mating tongue 122 received therein. In this arrangement, both the contacting section 201 and the intermediate section 202 of the grounding contact 21 are wholly intimately contacted by the conductive plastic portion 11, compared with the traditional connector which uses the respective grounding bar which only contacts a portion of either the contacting section or the intermediate section of the grounding contact instead.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a plastic housing retaining a plurality of contacts therein, said plastic housing including a conductive plastic portion with a plurality of grounding contacts retained therein to form a primary sub-assembly, and an insulative plastic portion with a plurality of differential pair signal contacts retained therein to form a secondary sub-assembly; wherein the secondary sub-assembly is retained by the primary sub-assembly, and the grounding contacts are commonly electrically connected to the conductive plastic portion while the differential pair signal contacts are isolated from the conductive plastic portion via the insulative plastic portion; wherein the differential pair signal contacts are located intimately between two corresponding grounding contacts along a longitudinal direction in a same mating port.

2. The electrical connector as claimed in claim 1, wherein the differential pair signal contacts are integrally formed within the insulative plastic portion via an insert-molding process.

3. The electrical connector as claimed in claim 2, wherein the grounding contacts are integrally formed within the conductive plastic portion via another insert-molding process.

4. The electrical connector as claimed in claim 1, wherein said secondary sub-assembly is initially formed as a contact module and successively assembled to the primary sub-assembly forwardly in a front-to-back direction perpendicular to the longitudinal direction.

5. The electrical connector as claimed in claim 4, wherein the conductive plastic portion forms a stopping block rearwardly abutting against the insulative plastic portion.

6. The electrical connector as claimed in claim 5, wherein the housing includes a base and a mating tongue forwardly extending from the base in a front-to-back direction perpendicular to said longitudinal direction, and said stopping block is formed either around a front end of the mating tongue or in the base.

7. The electrical connector as claimed in claim 1, wherein said housing includes a base essentially composed of a conductive base of the conductive plastic portion and an insulative mating tongue of the insulative plastic portion, and a mating tongue extending from the base forwardly in a front-to-back direction perpendicular to the longitudinal direction, and essentially composed of a conductive mating tongue of the conductive plastic portion and an insulative mating tongue of the insulative plastic portion.

8. The electrical connector as claimed in claim 7, wherein the conductor base forms a receiving hole through which the plastic base passes during assembling.

9. The electrical connector as claimed in claim 7, wherein said conductive mating tongue forms a mounting recess in which the insulative mating tongue is received.

10. The electrical connector as claimed in claim 1, where the housing includes a base and a mating tongue extending forwardly from the base along a front-to-back direction perpendicular to the longitudinal direction, and each of said contacts includes a front contacting section exposed upon the mating tongue, a tail section exposed outside of the base, and an intermediate section between the contacting section and the tail section and retained in the base, both the contacting section and the intermediate section of the grounding contact being electrically connected to the conductive plastic portion.

11. The electrical connector as claimed in claim 1, wherein both said differential pair signal contacts and said grounding contacts are arranged in a same row along the longitudinal direction.

12. A method of making a high frequency electrical connector comprising steps of:

providing a primary sub-assembly with a plurality of grounding contacts integrally formed with a conductive plastic portion via an insert-molding process;

providing a secondary sub-assembly with a plurality of differential pair signal contacts integrally formed with an insulative plastic portion via another insert-molding process; and assembling the secondary sub-assembly into the primary sub-assembly; wherein the differential pair signal contacts are located intimately between two corresponding grounding contacts along a longitudinal direction in a same mating port, and the grounding contacts are commonly electrically connected to the conductive plastic portion while the differential pair signal contacts are isolated from the conductive plastic portion via the insulative plastic portion.

13. The method as claimed in claim 12, wherein the conductive plastic portion forms a receiving hole through which the insulative plastic portion is assembled into the conductive plastic portion forwardly in a front-to-back direction perpendicular to said longitudinal direction.

14. The method as claimed in claim 13, wherein said conductive plastic portion form a stopping block rearwardly abutting against the insulative plastic portion.

15. The method as claimed in claim 13, wherein the conductive plastic portion forms a mounting recess to receive the insulative plastic portion therein to have contacting section of the differential pair signal contacts being coplanar with those of the grounding contacts.

16. An electrical connector comprising:

a plastic housing including a conductive plastic portion extending along a longitudinal direction;

a plurality of grounding contacts directly retained by the conductive plastic portion; and a plurality of contact modules retained in the conductive plastic portion, each of said contact modules includes differential pair signal contacts retained in an insulative plastic portion; wherein the grounding contacts are commonly electrically connected to the conductive plastic portion while the differential pair signal contacts are isolated from the conductive plastic portion via the insulative plastic portion.

17. The electrical connector as claimed in claim 16, wherein the differential pair signal contacts and the grounding contacts are arranged in a same row along the longitudinal direction in a same mating port for mating with a complementary connector.

18. The electrical connector as claimed in claim 17, wherein the contact modules are assembled into the conductive plastic portion.

19. The electrical connector as claimed in claim 18, wherein said conductive plastic portion forms a stopping block rearwardly abutting against the contact module in a front-to-back direction perpendicular to said longitudinal direction.

20. The electrical connector as claimed in claim 18, wherein the conductive plastic portion forms a mounting recess to receive the insulative plastic portion therein to have contacting section of the differential pair signal contacts being coplanar with those of the grounding contacts with regard to a vertical direction perpendicular to the longitudinal direction.

* * * * *